US005566484A

United States Patent [19]

Wachter

[11] Patent Number: 5,566,484

[45] Date of Patent: Oct. 22, 1996

[54] INTERNALLY ILLUMINATED SIGN

[75] Inventor: Peter F. Wachter, Northfield, Ill.

[73] Assignee: Juno Lighting, Inc., Des Plaines, Ill.

[21] Appl. No.: 546,118

[22] Filed: Oct. 20, 1995

[51] Int. Cl.[6] ..... G09F 13/04

[52] U.S. Cl. ..... 40/570; 40/590/578

[58] Field of Search ..... 40/570, 564, 568, 40/572, 574, 575, 578, 579, 580

[56] References Cited

U.S. PATENT DOCUMENTS

| | | | |
|---|---|---|---|
| 3,478,455 | 11/1969 | Fremont | 40/570 |
| 4,355,479 | 10/1982 | Thornton | 40/570 |
| 4,967,317 | 10/1990 | Plumly | 40/570 X |

*Primary Examiner*—Kenneth J. Dorner
*Assistant Examiner*—Cassandra Davis
*Attorney, Agent, or Firm*—Anthony S. Zummer

[57] ABSTRACT

An internally illuminated sign having opposed directional indicating arrow openings including a housing. A light source is mounted in the housing. The housing has a flat stencil with letter openings forming a message. A first directional indicating arrow opening is positioned adjacent to one end of the message and a second directional indicating arrow opening is positioned at the other end of the message. The two arrow openings indicate direction in opposite directions, each away from the message. A first arrow cover is positioned in the first arrow opening and a second arrow cover is positioned in the second arrow opening. A stiff resilient translucent sheet diffuser is mounted on the stencil between the stencil and the light source. The translucent sheet holds the arrow covers in their respective arrow openings. A first open cut in the translucent sheet diffuser is deployed adjacent to a portion of the first arrow cover and a second open cut in the translucent sheet diffuser is deployed adjacent to the second arrow cover. Each of the arrow covers is removable from the respective arrow opening by displacing a portion of the translucent sheet and being removable through the open cut in the displaced portion.

20 Claims, 3 Drawing Sheets

INTERNALLY ILLUMINATED SIGN

BACKGROUND OF THE INVENTION

Internally illuminated signs are customarily required by fire and building codes of various governmental agencies to identify an exit or a direction to an exit. An acceptable construction of such an internally illuminated sign is one wherein the letters for the word "EXIT" are cut in a stencil and a directional indicating arrow opening is cut into the stencil at each end of the word "EXIT". When the manufacturer of the sign ships the sign, the sign is shipped with solid arrow covers in the respective arrow openings in the stencil so that no direction is indicated. Upon selection of the location for mounting the sign, one of the arrow covers may be removed from an opening so that the arrow opening is illuminated, thereby indicating direction. This general type of construction is well known. An example of such a construction is shown in U.S. Pat. No. 5,247,756, entitled, "Sign Apparatus With Insertable Directional Arrow" issued Sep. 28, 1993, to Robert M. Johnstone.

The Johnstone disclosure teaches the use of arrows mounted in openings in a stencil, wherein the arrows are held in position by a snap action. The snap action requires a fabrication wherein close tolerances must be maintained so that the arrows may be readily removed and inserted relative to the supporting stencil.

SUMMARY OF THE INVENTION

The present invention is an internally illuminated sign having a housing and a light source mounted in the housing. The housing has a flat stencil with letter openings in the stencil forming a message. A first directional indicating arrow opening is positioned adjacent to one end of the message and a second indicating arrow opening is positioned adjacent to the other end of the message. The first and second arrow openings indicate opposed directions each away from the message. A first arrow cover is removably positioned in the first arrow opening and a second arrow cover is removably positioned in the second arrow opening. A stiff resilient translucent sheet diffuser is mounted on the stencil between the stencil and the light source. The translucent sheet diffuser holds the first and second arrow covers in their respective openings. The translucent sheet diffuser has a first open cut deployed adjacent to a portion of the first arrow cover and a second open cut deployed adjacent to a portion of the second arrow cover. The portions of the translucent sheet defined by the open cuts are resiliently displaceable to allow the arrow covers to be selectively removed from their respective openings.

DETAILED DESCRIPTION

Figure 1:
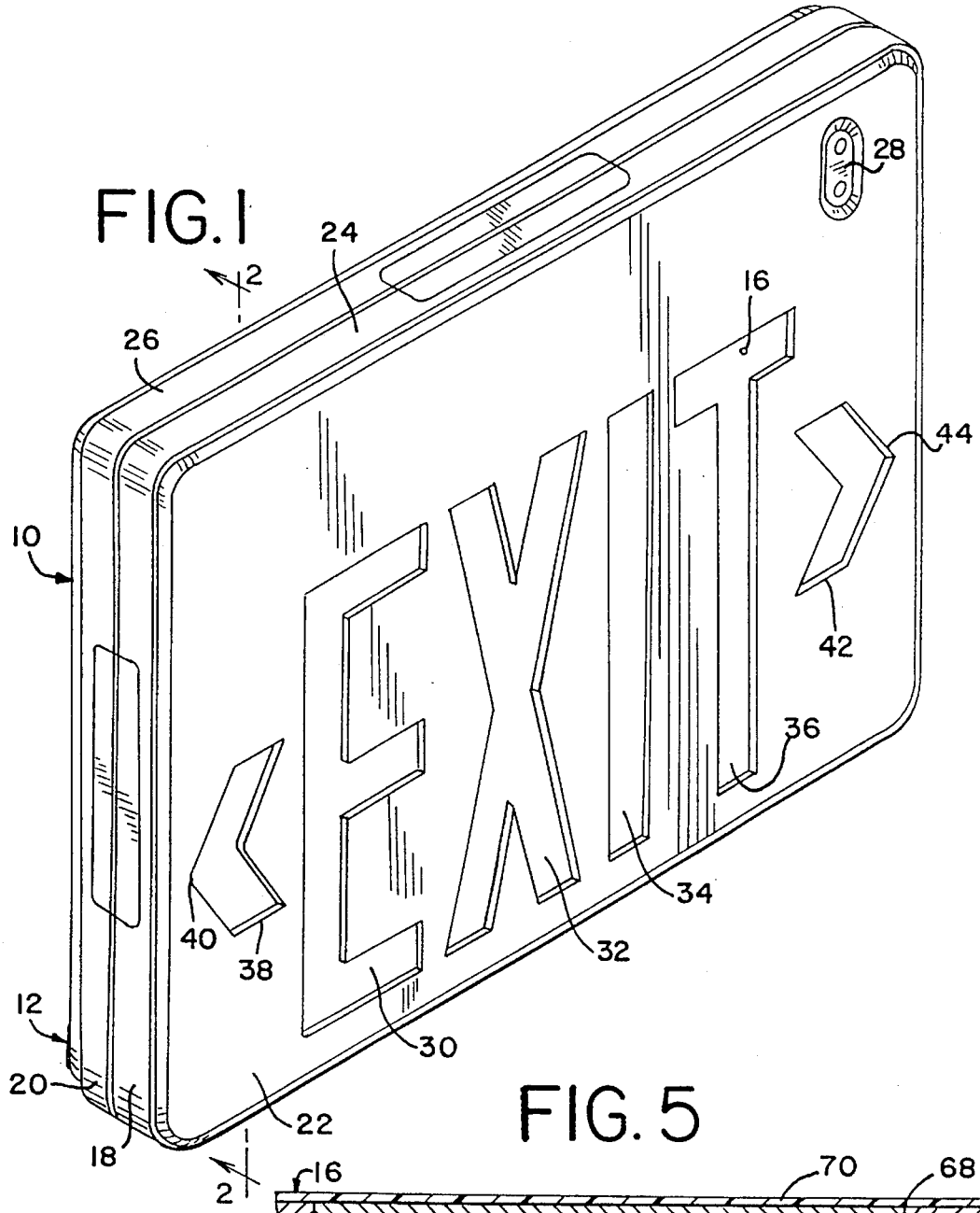
FIG. 1 is a perspective view of an internally illuminated sign embodying the instant invention.
Figure 2:
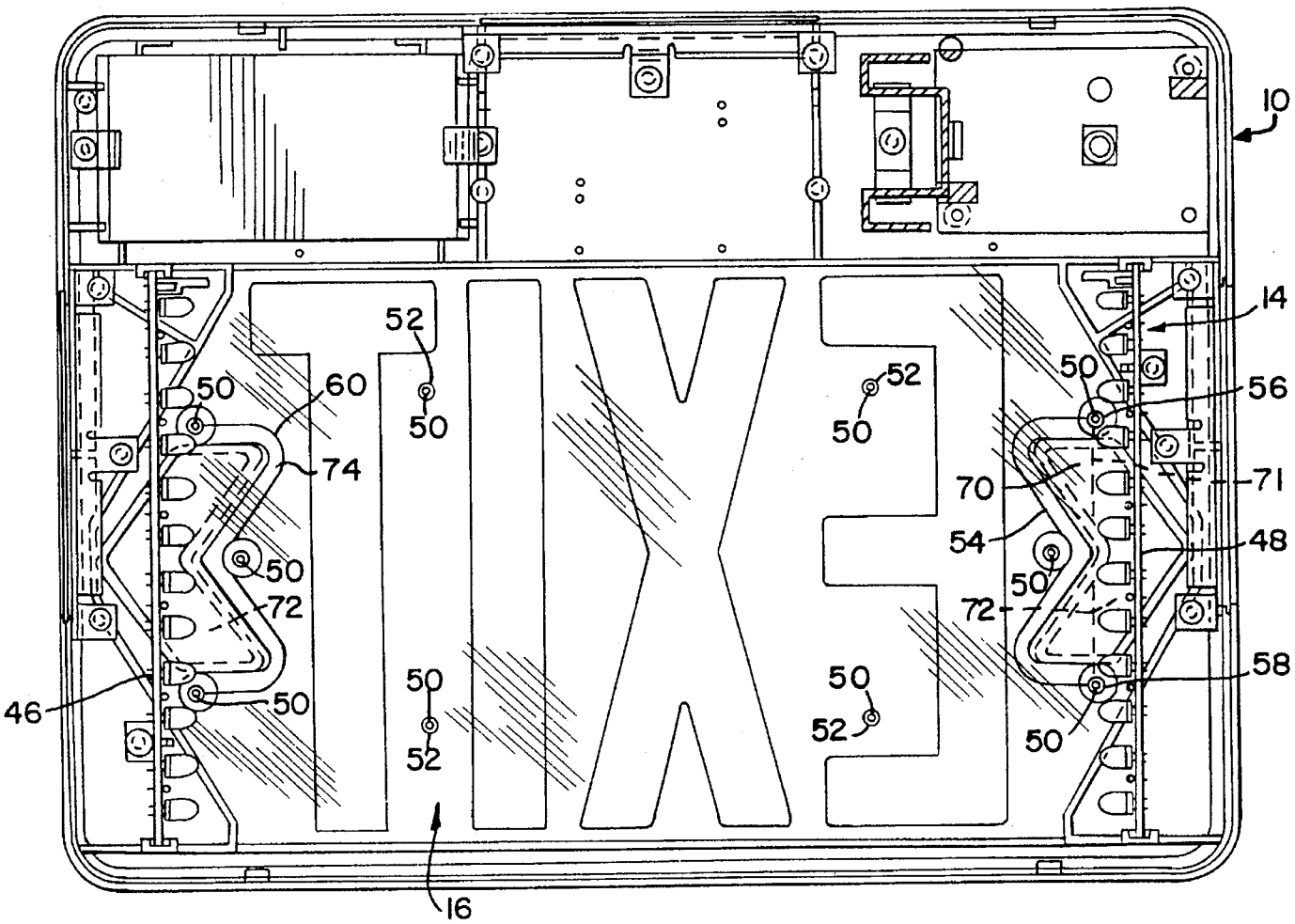
FIG. 2 is a cross sectional view through a plane parallel to the face of the internally illuminated sign of FIG. 1 showing a portion of a housing with a translucent sheet diffuser mounted thereon and a light source assembly mounted in the housing.

Referring now to the drawings, and especially to FIGS. 1 and 2, an internally illuminated sign generally indicated by numeral 10 is shown therein and is a specific embodiment of the instant invention. Sign 10 generally includes a housing 12 with a conventional light source assembly 14 mounted in the housing. A stiff resilient translucent sheet diffuser 16 is mounted on an interior surface of the housing between the housing and a portion of the light source assembly.

Housing 12 is conventional in its construction, in that, it includes a pair of mateable halves 18 and 20. The general construction of the housing is well known. Housing half 18 includes a substantially flat stencil 22 with a closure wall 24 formed integral with the periphery of the stencil for engagement with a like closure wall 26 of housing half 20. A conventional test switch and test lamp assembly 28 is mounted in one corner of stencil 22, as is conventional. The stencil 22 has four (4) letter openings, 30, 32, 34, and 36 formed therein, which letter openings spell out the message "EXIT". The stencil includes a first directional indicating arrow opening 38 adjacent to the letter opening 30. The arrow opening has a first directional indicating point 40 indicating a direction away from the word "EXIT". A second directional indicating arrow opening 42 is formed in the stencil adjacent to the letter opening 36. The second arrow opening 42 has a second directional indicating point 44 indicating a direction away from the message, and opposite to the direction indicated by indicating point 40.

Light source assembly 14, as is conventional, includes a converter and an electric storage source to store electrical energy to illuminate a first series of conventional illuminating lamps 46 at one end of the housing and a second series of conventional illuminating lamps 48 at the other end of the housing as may be best seen in FIG. 2. The construction of light source assembly 14 is well known in the art.

Diffuser 16, in this instance, is a stiff resilient translucent sheet of polyester having a thickness of 0,019 inches (0,048 centimeters) sold under the trademark MYLAR by E. I. du Pont de Nemours & Co. The diffuser may be any required color to color light the openings in the stencil. Typically, the color required by a building code is either red or green. The material of the diffuser may be of a chemical formulation or thickness which provides the required resilience for the given material.

The inside surface of the stencil has a plurality of posts 50 fixed therein perpendicular to the stencil. Diffuser 16 has a plurality of openings 52 which mateably receive posts 50. A well known clip (not shown herein) is mounted on the posts and in contact with the diffuser to hold the diffuser against the interior surface of the stencil, as is conventional.

Figure 4:
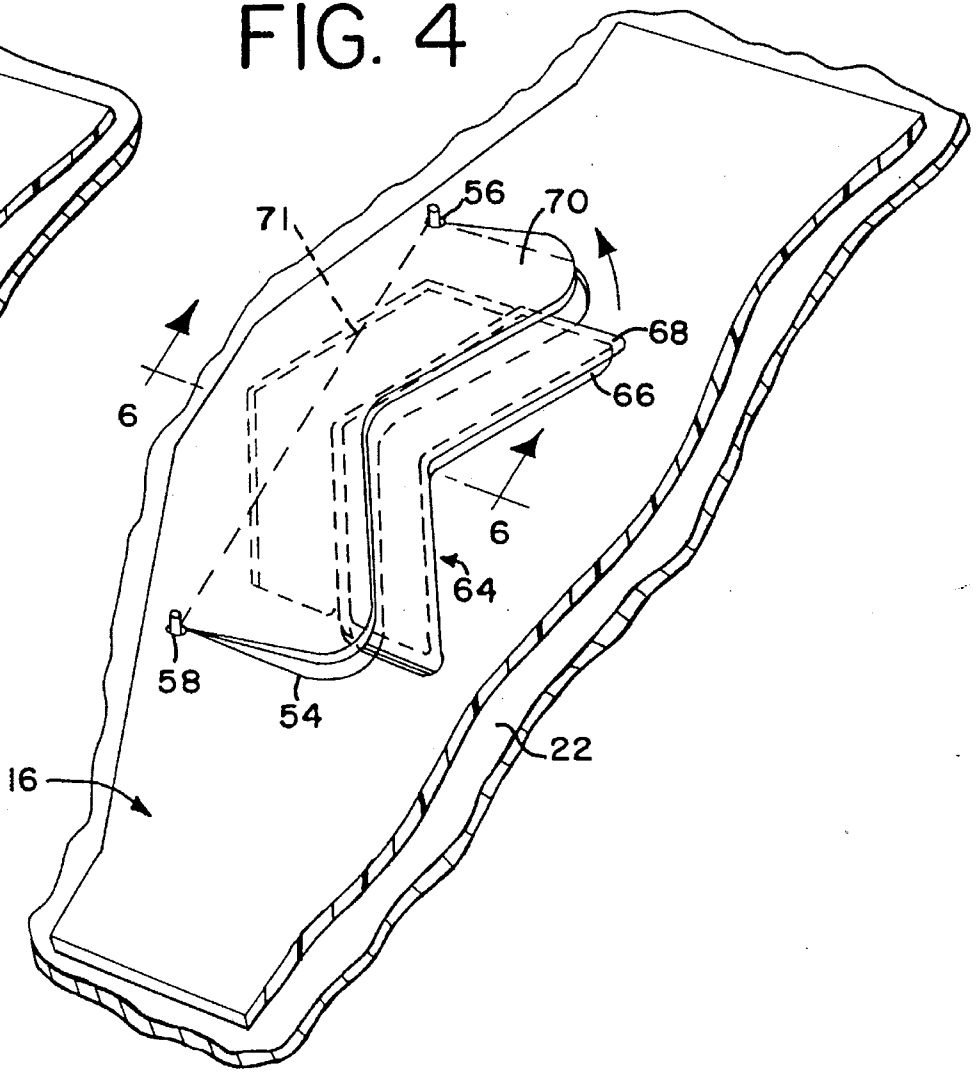
FIG. 4 is an enlarged fragmentary perspective view similar to FIG. 3, but showing the arrow cover partially removed from the arrow opening and showing a portion of the translucent sheet diffuser resiliently displaced to allow the arrow cover to be removed.
Figure 3:
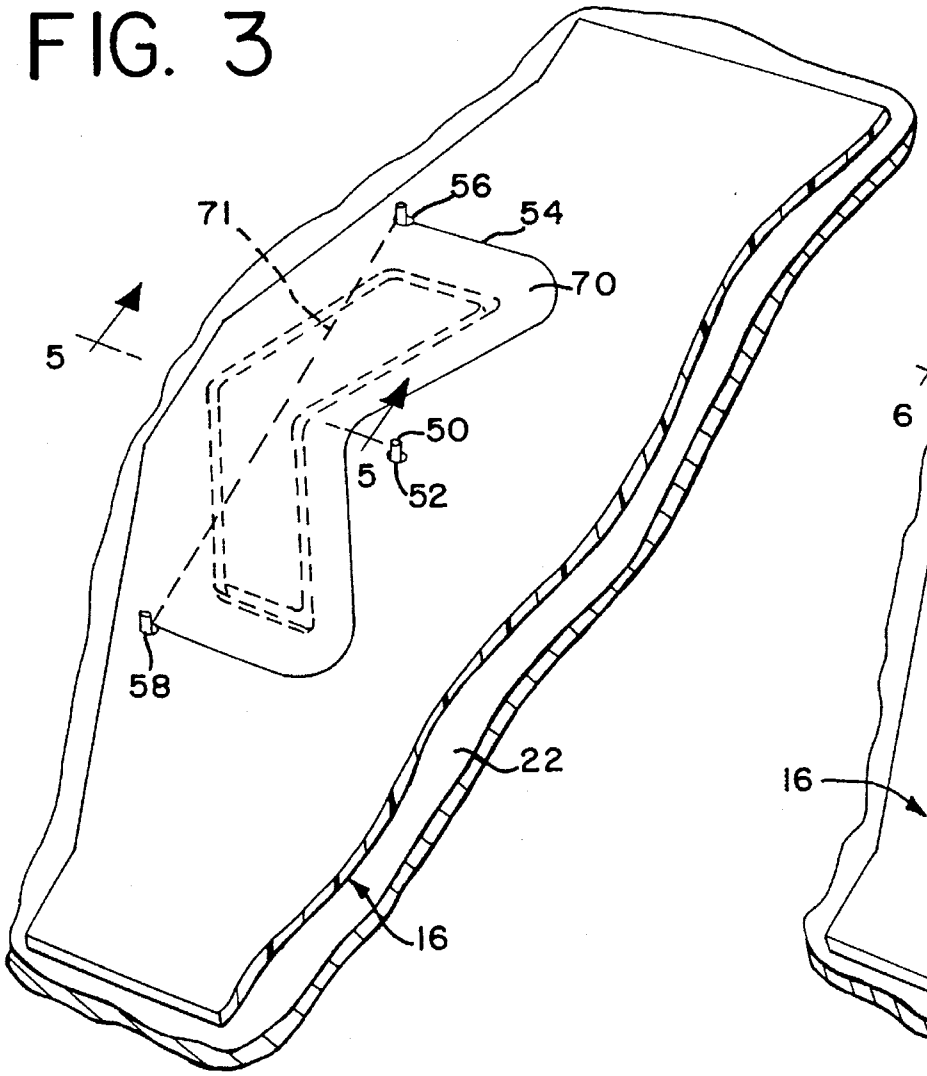
FIG. 3 is an enlarged fragmentary perspective view of a portion of a stencil which is part of the housing of the sign of FIG. 1, a portion of a translucent sheet diffuser connected to the stencil and an arrow cover mounted in an arrow opening in the stencil shown in dotted form.

The diffuser has an open die cut 54 deployed adjacent to a portion of the arrow opening 38, as may be best seen in FIGS. 3 and 4. The die cut is similar in configuration to that portion of the arrow opening to which it is adjacent. Die cut 54 has one end terminating at a first circular opening 56 and the other end of the die cut terminating at a second circular opening 58. Posts 50 extend through openings 56 and 58. A die cut 60 identical to die cut 54 is formed in diffuser 16 adjacent to a portion of arrow opening 42 with like circular openings at opposite ends of the die cut. Die cut 60 is similar in configuration to the portion of arrow opening 42 to which it is adjacent.

Figure 6:
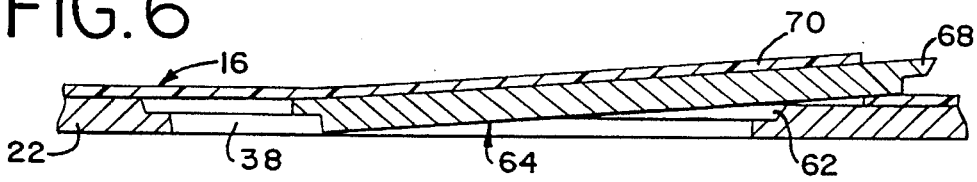
FIG. 6 is an enlarged cross sectional view taken on Line 6—6 of FIG. 4 showing the arrow cover partially removed from the arrow opening and a portion of the translucent sheet diffuser resiliently displaced to allow removal of the arrow cover.
Figure 7:
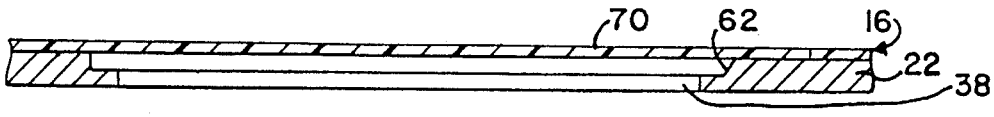
FIG. 7 is a cross sectional view similar to FIGS. 5 and 6, but with the arrow cover removed from the arrow opening and the portion of the translucent sheet diffuser shown displaced in FIG. 6 returned to its closed position.

As may be seen in FIGS. 6 and 7, stencil 22 has a rabbet or recessed portion 62 around the entire periphery of arrow opening 38. Stencil 22 has a like rabbet or recessed portion around arrow opening 42.

Figure 5:
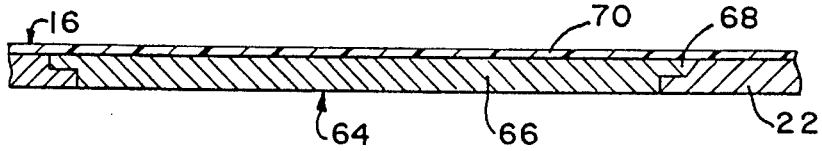
FIG. 5 is an enlarged cross sectional view taken on Line 5—5 of FIG. 3 showing an arrow cover in a respective arrow opening in a stencil.

An arrow cover 64 is mateably and releasably positioned in arrow opening 38. Arrow cover 64 includes an arrow body 66 with a stop or flange 68 formed integral with the periphery of body 66. As may be best seen in FIG. 5, arrow cover 64 fits into the arrow opening 38 with the flange 68 positioned in the rabbet or recessed portion 62. Cooperation of arrow cover flange 68 with rabbet or recessed portion 62 creates a light seal so that light from illuminating lamps 46 and 48 does not pass through the arrow opening.

Die cut 54 defines a movable portion 70 of diffuser 16. As may be seen in FIG. 5, movable portion 70 of the diffuser holds arrow cover 64 in arrow opening 38. The stiffness of the diffuser is sufficiently great to hold the arrow in position. However, if it is desired to remove arrow cover 64 from arrow opening 38, it is necessary only to push against arrow body 66 to raise bends on an imaginary straight line 71 between openings 56 and 58. Line 71 is adjacent to indicating point 40. Arrow cover 64 is slipped out through die cut 54, as shown in FIG. 6. Once arrow cover 64 is removed, the resilience of the diffuser causes movable portion 70 to snap back into the attitude shown in FIG. 7. Thus, the light source illuminates the arrow opening through the diffuser adjacent to the stencil color lighted providing a direction indicating message.

An arrow cover 72, identical to arrow cover 64, is mounted in arrow opening 42. Arrow cover 72 is held in position by a deformable movable portion 74 formed by die cut 60 in the diffuser. Arrow cover 72 may be removed from arrow opening 42 in a like manner as described above for the removal of arrow cover 64. Stencil 22 has a rabbet or recessed portion around arrow opening 42 identical to rabbet or recessed portion 62 around arrow opening 38.

An arrow cover may be replaced in its respective arrow opening by displacing the movable portion of the diffuser and slipping the arrow cover through the respective die cut under its respective movable portion of the diffuser, then sliding the arrow cover into its respective arrow opening. The resilience of the diffuser holds the arrow cover in its arrow opening effectively providing a light seal.

The instant internally illuminated sign 10 is shipped by the manufacturer with an arrow cover in each of the arrow openings. Once the sign is on site and it is determined that it is necessary to show direction with the sign, a workman need only remove a selected arrow cover to illuminate an arrow opening to show direction. Even though the workman may make an error in removing the wrong arrow cover, the arrow cover may be reinserted into the arrow opening and the other arrow cover removed from the opposite arrow opening to indicate the opposite direction. Should a workman remove an arrow cover and discard the arrow cover, but then it be decided that the sign should show a direction opposite to the indicated direction, the indication of direction may be easily changed inasmuch as the arrow covers and arrow openings are identical in their respective constructions. The arrow cover from the opposite side of the message may be removed and inserted in the arrow opening indicating the incorrect direction, and thereby reverse the indicated direction remedying any problem created by discarding an arrow cover.

Although a specific embodiment of the present invention has been shown in detail and described in detail above, it is readily apparent that those skilled in the art may make various modifications and changes to the herein disclosed internally illuminated sign without departing from the spirit and scope of the present invention. Materials and sizes of materials and parts may be changed all within the scope of the instant invention. The present invention is limited only by the appended claims.

What is claimed is:

1. An internally illuminated sign including; a housing, a light source mounted in the housing, said housing having a flat stencil, said stencil having letter openings forming a message, a first directional indicating arrow opening positioned adjacent to one end of the message, said first arrow opening having a directional indicating first point extending away from the message indicating a direction away from the message, a second directional indicating arrow opening positioned adjacent to a second end of the message opposite to said one end, said second arrow opening having a directional indicating second point extending away from the message in a direction opposite to the directional indicating first point, a first arrow cover removably positioned in the first arrow opening, said first arrow cover having a first arrow body mateably removably positioned in the first arrow opening, said first arrow cover having a first stop on the first arrow body cooperative with the stencil preventing the first arrow cover from passing through the first arrow opening in a direction away from the light source, a second arrow cover removably positioned in the second arrow opening, said second arrow cover having a second arrow body mateably removably positioned in the second arrow opening, said second arrow cover having a second stop on the second arrow body cooperative with the stencil preventing the second arrow cover from passing through the second arrow opening in a direction away from the light source, and a stiff resilient translucent sheet positioned between the stencil and the light source, said translucent sheet holding the first and second arrow covers in the respective arrow openings, said translucent sheet having a first open cut deployed adjacent to a portion of the first arrow opening, said first open cut defining a portion of the sheet being resiliently displaceable to allow the first arrow cover to be removed from the first arrow opening through the first open cut, and said translucent sheet having a second open cut deployed adjacent to a portion of the second arrow opening, said second open cut defining a portion of the sheet being resiliently displaceable to allow the second arrow cover to be removed from the second arrow opening through the second open cut.

2. An internally illuminated sign as defined in claim 1, wherein said first open cut has a portion positioned between the first arrow opening and the message, said portion of the sheet defined by the first open cut is bendable on a line spaced from and adjacent to the directional indicating first point.

3. An internally illuminated sign as defined in claim 1, wherein each open cut has one end terminating in a first circular opening and an opposite end terminating in a second circular opening, each portion of the translucent sheet defined by each open cut is bendable on a line extending between the respective circular openings.

4. An internally illuminated sign as defined in claim 1, wherein each open cut has a shape which generally follows the contour of a portion of the outline of its respective adjacent arrow opening.

5. An internally illuminated sign as defined in claim 1, wherein the stop of each arrow cover is a flange extending around the entire periphery of the respective arrow body, the flange of each arrow cover being cooperative with the stencil to effect a light seal to prevent any light from the light source from passing through each respective arrow opening when the respective arrow cover is positioned in its respective arrow opening.

6. An internally illuminated sign as defined in claim 1, wherein the stencil has a recessed portion adjacent to each arrow opening to receive mateably the respective stop on each respective arrow body.

7. An internally illuminated sign as defined in claim 1, wherein said first open cut has a portion positioned between the first arrow opening and the message, said second open cut having a portion positioned between the second arrow opening and the message, each open cut has one end terminating in a respective first circular opening and an opposite end of each open cut terminating in a respective second circular opening, each portion of the translucent sheet defined by each open cut is bendable on a line extending between respective circular openings the ends of each of the open cuts.

8. An internally illuminated sign as defined in claim 1, wherein each open cut has a shape which generally follows the contour of a portion of the outline of its respective adjacent arrow opening, said first open cut having a portion positioned between the first arrow opening and the message, the portion of the sheet defined by the first open cut is bendable on a line spaced from and adjacent to the first directional indicating point, and said second open cut having a portion positioned between the second arrow opening and the message, the portion of the sheet defined by the second open cut is bendable on a line spaced from and adjacent to the second directional indicating point.

9. An internally illuminated sign as defined in claim 1, wherein each open cut has a shape which generally follows the contour of to a portion of the outline of its respective adjacent arrow opening, each open cut has one end terminating in a respective first circular opening and an opposite end terminating in a respective second circular opening, each portion of the translucent sheet defined by each open cut is bendable on a respective line extending between said first and second respective circular openings of each of the open cuts, said first open cut having a portion positioned between the first arrow opening and the message, and said second open cut having a portion positioned between the second arrow opening and the message.

10. An internally illuminated sign as defined in claim 1, wherein the stop of each arrow cover is a flange extending around the entire periphery of the respective arrow body, a recessed portion in the stencil adjacent to each arrow opening to receive mateably the respective flange on each respective arrow body, the flange of each arrow cover being cooperative with the stencil to effect a light seal to prevent any light from the light source from passing through the respective arrow opening when each respective arrow cover is positioned in its respective arrow opening.

11. An internally illuminated sign as defined in claim 1, wherein the stop of each arrow cover is a flange extending around the entire periphery of the respective arrow body, the flange of each arrow cover being cooperative with the stencil to effect a light seal to prevent any light from the light source from passing through the respective arrow opening when the respective arrow cover is positioned in its respective arrow opening, said first open cut having a portion positioned between the first arrow opening and the message, and said second open cut having a portion positioned between the second arrow opening and the message, each portion of the sheet defined by each of the open cuts is bendable on a line spaced from and adjacent to the respective directional indicating point.

12. An internally illuminated sign as defined in claim 1, wherein the stencil has a recessed portion adjacent to each arrow opening to receive mateably the respective stop on each respective arrow body, said first open cut having a portion positioned between the first arrow opening and the message, and said second open cut having a portion positioned between the second arrow opening and the message.

13. An internally illuminated sign as defined in claim 1, wherein said first open cut has a portion positioned between the first arrow opening and the message, said second open cut having a portion positioned between the second arrow opening and the message, each open cut has one end terminating in a first circular opening and an opposite end terminating in a second circular opening, each portion of the translucent sheet defined by a respective open cut is bendable on a line extending between the respective first and second circular cuts, the stop of each arrow cover is a flange extending around the entire periphery of the respective arrow body, the flange of each arrow cover being engagable with the stencil to effect a light seal to prevent any light from the light source from passing through the respective arrow opening when the respective arrow cover is positioned in the respective arrow opening.

14. An internally illuminated sign as defined in claim 1, wherein the stencil includes a recessed portion adjacent to each arrow opening to receive mateably the respective stop of each respective arrow body, each open cut has one end terminating in a respective first circular opening and an opposite end terminating in a respective second circular opening, said first open cut having a portion between the first arrow opening and the message, the portion of the sheet defined by the first open cut is bendable on a line extending between the respective first and second circular openings, said line is spaced from and adjacent to the first directional indicating point, and said second open cut having a portion positioned between the second arrow opening and the message, the portion of the sheet defined by the second open cut is bendable on a second line extending between the respective first and second circular openings, said second line is adjacent to the second directional indicating point.

15. An internally illuminated sign as defined in claim 1, wherein each open cut has a shape which generally follows the contour of a portion of the outline of its respective arrow opening, said first open cut having a portion positioned between the arrow opening and the message, said second open cut having a portion positioned between the second arrow opening and the message, the stop of each arrow cover being a flange extending around the entire periphery of the respective arrow body, the flange of each arrow cover cooperative with the stencil to effect a light seal to prevent any light from the light source from passing through the respective arrow opening when the respective arrow cover is positioned in its respective arrow opening.

16. An internally illuminated sign as defined in claim 1, wherein said first open cut having a portion positioned between the first arrow opening and the message, the portion of the sheet defined by the first open cut is bendable on a line adjacent to the first directional indicating point, said second open cut having a portion positioned between the second arrow opening and the message, the portion of the sheet defined by the second open cut is bendable on a second line adjacent to the second directional indicating point, the stop of each arrow cover being a flange extending around the entire periphery of the respective arrow body, a recessed portion in said stencil adjacent to each arrow opening to receive mateably the respective flange on each respective arrow body, the flange of each arrow cover cooperating with the stencil to effect a light seal to prevent any light from the light source from passing through the respective arrow opening when the respective arrow cover is positioned in its respective arrow opening.

17. An internally illuminated sign as defined in claim 1, wherein each open cut has one end terminating in a respective first circular opening and an opposite end terminating in a respective second circular opening, each portion of the translucent sheet defined by each open cut is bendable on a line extending between the respective circular openings, the stop of each arrow cover being a flange extending around the entire periphery of the respective arrow body, the flange of each arrow cover being mountably cooperative with the stencil to effect a light seal to prevent any light from the light source from passing through the respective arrow opening when the respective arrow cover is positioned in its respective arrow opening.

18. An internally illuminated sign as defined in claim 1, wherein each open cut has a shape which generally follows the contour of a portion of the outline of its respective arrow opening, each open cut has one end terminating in a respective first circular opening and an opposite end terminating in a respective second circular opening, each portion of the translucent sheet defined by each open cut is bendable on a line extending between the respective circular openings, the stop of each arrow cover being a flange extending around the entire periphery of the respective arrow body, the flange of each arrow cover being cooperative mountably with the stencil to effect a light seal to prevent any light from the light source from passing through the respective arrow opening when the respective arrow cover is positioned in its respective arrow opening.

19. An internally illuminated sign as defined in claim 1, wherein the stencil has a recessed portion adjacent to each arrow opening to receive mateably the respective stop on each respective arrow body, each open cut has one end terminating in a respective first circular opening and an opposite end terminating in a respective second circular opening, each portion of the translucent sheet defined by each open cut is bendable on a line extending between the respective circular openings, each open cut has a shape which generally follows the contour of a portion of the outline of its respective arrow opening.

20. An internally illuminated sign as defined in claim 1, wherein each open cut has one end terminating in a respective first circular opening and an opposite end terminating in a respective second circular opening, each open cut has a shape which generally follows the contour of a portion of the outline of its respective arrow opening, said first open cut having a portion positioned between the first arrow opening and the message, the portion of the sheet defined by the first open cut is bendable on a line extending between the respective circular openings spaced from and adjacent to the first directional indicating point, said second open cut having a second portion positioned between the second arrow opening and the message, the second portion of the sheet defined by the second open cut is bendable on a second line extending between the respective circular opening spaced from and adjacent to the second directional indicating point, the stop of each arrow cover being an integral flange extending around the entire periphery of the respective arrow body, a recessed portion in the stencil adjacent to each arrow opening, the flange of each arrow cover being positioned in its respective recessed portion and cooperative with the stencil to effect a light seal to prevent any light from the light source from passing through the respective arrow opening when the respective arrow cover is positioned in its respective arrow opening.

* * * * *